US005269717A

United States Patent [19]

Tardif

[11] Patent Number: 5,269,717

[45] Date of Patent: Dec. 14, 1993

[54] DISHWARE HAVING A LIQUID-FILLED RIM AND EATING IMPLEMENTS

[75] Inventor: Pierre Tardif, Longueuil, Canada

[73] Assignee: Genin Trudeau, Boucherville, Canada

[21] Appl. No.: 975,412

[22] Filed: Nov. 12, 1992

[51] Int. Cl.[5] ..... A63H 33/00; A63H 3/00; A63H 33/26; A63H 3/52

[52] U.S. Cl. ..... 446/71; 446/74; 446/132; 446/135; 446/267; 206/457; 206/818; 220/574

[58] Field of Search ..... 206/457, 818; 220/574, 220/574.1, 575; 446/71, 72, 73, 74, 76, 77, 129, 131, 132, 133, 134, 135, 136, 219, 267

[56] References Cited

U.S. PATENT DOCUMENTS

| | | | |
|---|---|---|---|
| 1,544,267 | 6/1925 | Munson | 206/457 X |
| 2,530,736 | 11/1950 | Sheldon | 220/575 X |
| 2,665,913 | 1/1954 | Hlavac | 446/129 X |
| 2,747,872 | 5/1956 | Harvey | 446/135 X |
| 3,534,496 | 10/1970 | Gardel et al. | 446/134 |
| 3,791,550 | 2/1974 | Duncan | 446/73 X |
| 4,625,882 | 12/1986 | Sullivan | 206/457 X |
| 4,863,033 | 9/1989 | Buj | 206/457 X |
| 4,928,412 | 5/1990 | Nishiyama | 446/267 X |
| 5,047,267 | 9/1991 | Pantaleo et al. | 446/267 X |
| 5,092,807 | 3/1992 | Lew et al. | 446/219 |

FOREIGN PATENT DOCUMENTS

| | | | |
|---|---|---|---|
| P 12239 | 11/1955 | Fed. Rep. of Germany | 446/134 |
| 1459683 | 2/1989 | U.S.S.R. | 446/135 |

*Primary Examiner*—Robert A. Hafer
*Assistant Examiner*—D. Neal Muir
*Attorney, Agent, or Firm*—Michael Ebert

[57] ABSTRACT

Novelty dishware for serving food to children and implements associated with the dishware which function not only as eating utensils but also as play pieces, so that the eating process becomes a play activity which encourages eating. The dishware, which may be in bowl, plate or any other receptacle form adapted to accommodate food, includes a rim constituted by an annular, transparent duct filled with liquid having glitter particles dispersed therein, as well as a permanent-magnet piston. The piston is slidable in the duct to force the liquid to circulate and thereby animate the particles to create a dynamic display. Each implement is provided with a transparent handle that is filled with liquid having glitter particles dispersed therein, the free end of the handle having a permanent magnet actuator attached thereto. The actuator is magnetically linked to the piston when the free end of the handle is placed on the surface of the duct at a position adjacent the piston, whereby sliding movement of the actuator along the surface of the duct is accompanied by sliding movement of the piston within the duct to cause the liquid therein to circulate.

9 Claims, 3 Drawing Sheets

DISHWARE HAVING A LIQUID-FILLED RIM AND EATING IMPLEMENTS

BACKGROUND OF INVENTION

1. Field of Invention

This invention relates generally to dishware such as bowls and plates for serving food and eating implements associated with the dishware, and more particularly to dishware and implements for use by children which function not only as eating utensils, but also as play pieces, so that the eating process becomes a play activity that stimulates a child to partake of food.

2. Status of Prior Art

As pointed out in the column on Health in The New York Times of Oct. 21, 1992, play activity is of vital importance in child development. Research has shown that children who play often become more creative than those whose exposure to play and toys is more limited. Through play, a child can develop better hand-eye coordination, improved problem-solving skills and a richer imagination.

Proper nutrition is essential to a child's health and growth. Food is brought to a table in dishware whose form depends on the food being served to the child. Thus, soup is generally served in a bowl and is consumed by means of a spoon, whereas cooked vegetables are placed in a shallow plate and consumed by means of a knife and fork. By dishware, as this term is used herein, is meant any round receptacle adapted to accommodate food to be eaten.

Yet many children, particularly those of preschool age, are indifferent eaters. As a consequence, parents seek ways to coax a child to eat the food placed before him in a serving bowl or plate. Thus, a parent may promise to reward a child with a piece of candy for each mouthful of food he consumes. This is not good practice, for candy has a high sugar and fat content, and while candy taken in small quantities is not harmful, a child who accumulates a large quantity of candy pieces as a reward for eating his dinner will gain little benefit by eating these pieces.

Nor is it normally good practice to intermingle play and eating activity; for as the child becomes involved in play, he tends to lose whatever interest or appetite he has in eating. For example, a child who is given a toy vehicle to play with on the table surface on which a food serving dish is set cannot be expected to spoon food from this dish and thereby interrupt his play.

A child whose interest in food is weak will be encouraged to eat if the eating process itself is made an enjoyable activity rather than a chore imposed on him by his parents or because he is threatened that unless he eats he will not grow big and strong.

We have found that an effective technique for stimulating a child's appetite and inducing him to eat is to convert eating into a play activity, so that the eating utensils also function as play pieces and to carry out play, the child must eat. In psychological terms, the play activity then affords positive reinforcement to the eating process. However, conventional dishware and eating implements are not adapted to function as play pieces.

SUMMARY OF INVENTION

In view of the foregoing, the main object of this invention is to provide novelty dishware for children and eating implements associated with the dishware which function not only as eating utensils but also as play pieces, so that the eating process becomes a play activity and is stimulated thereby.

A significant advantage of the invention is that it encourages a child to eat, for it rewards the child by permitting him to engage in play only if he eats. With the invention, it becomes fun for a child to eat, not a forced activity.

More specifically, an object of the invention is to provide novelty dishware in the form of bowls, plates and other food-serving receptacles whose rim takes the form of a transparent circular duct filled with liquid having dispersed therein glitter particles and other decorative objects which are animated and create a dynamic display only when the liquid is caused to circulate in the duct.

Also an object of the invention is to provide eating implements, such as knives, forks and spoons, which are usable in conjunction with the novelty dishware, the handle of these implements being in the form of a transparent cylinder filled with liquid having glitter particles dispersed therein, the particles creating a dynamic display when the implements are manipulated by the child.

Yet another object of the invention is to provide dishware of the above type which includes a miniature permanent-magnet piston that is slidable within the annular duct to force the liquid therein to circulate, and in doing so to animate glitter particles to create a dynamic display, each implement having attached to the free end of its handle a miniature permanent-magnet actuator which is magnetically linked to the piston when the free end of the handle is placed on the top surface of the duct at a position adjacent the piston therein, whereby sliding movement of the actuator along this surface is accompanied by corresponding movement of the piston within the duct.

Still another object of the invention is to provide novelty dishware and eating implements of the above type which are of high strength and capable of withstanding rough handling, yet can be mass-produced at relatively low cost.

Briefly stated, these objects are attained in novelty dishware for serving food to children and implements associated with the dishware which function not only as eating utensils but also as play pieces, so that the eating process becomes a play activity which encourages eating. The dishware, which may be in bowl, plate or any other receptacle form adapted to accommodating food, includes a rim constituted by an annular, transparent duct filled with liquid having glitter particles dispersed therein, as well as a permanent-magnet piston. The piston is slidable in the duct to force the liquid to circulate and thereby animate the particles to create a dynamic display.

Each implement is provided with a transparent handle that is filled with liquid having glitter particles dispersed therein, the free end of the handle having a permanent-magnet actuator attached thereto. The actuator is magnetically linked to the piston when the free end of the handle is placed on the surface of the duct at a position adjacent the piston, whereby sliding movement of the actuator along the surface of the duct is accompanied by sliding movement of the piston within the duct to cause the liquid therein to circulate.

DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

The Bowl

Figure 1:
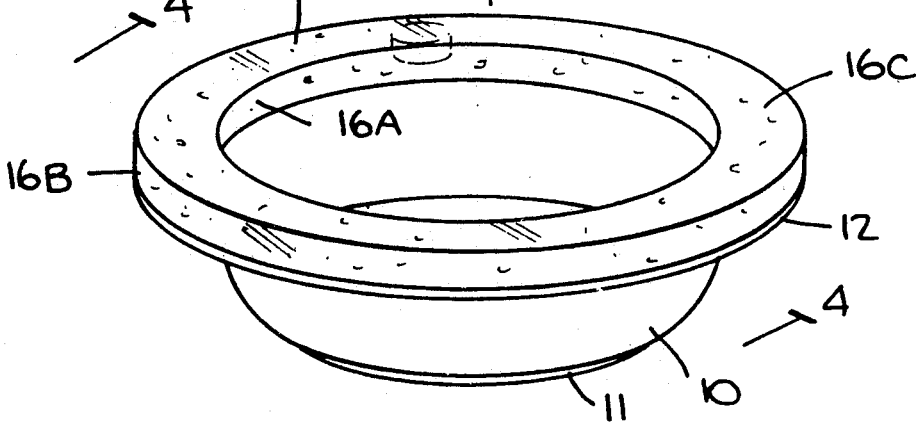
FIG. 1 is a perspective view of a novelty bowl in accordance with the invention.
Figure 2:
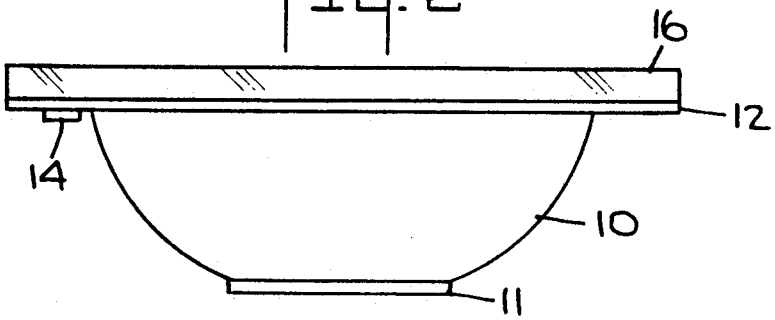
FIG. 2 is an end view of the bowl.
Figure 3:
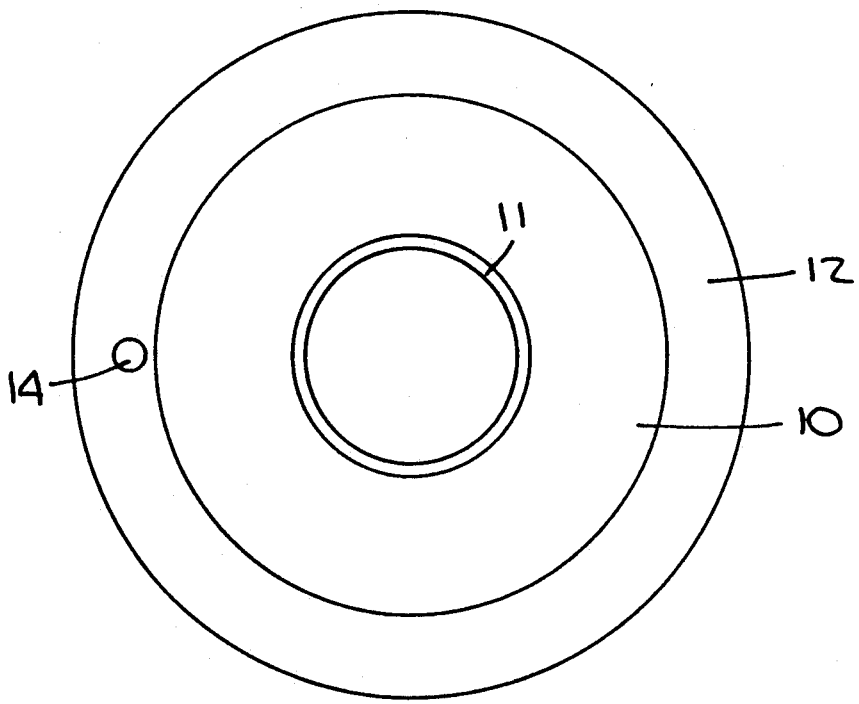
FIG. 3 is a bottom view of the bowl.
Figure 4:
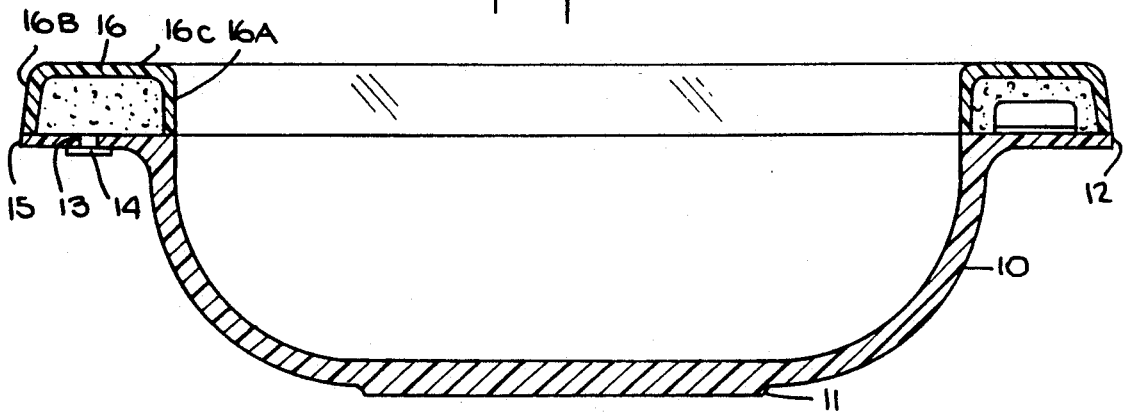
FIG. 4 is a section taken in the plane indicated by line 4—4 in FIG. 1.
Figure 5:
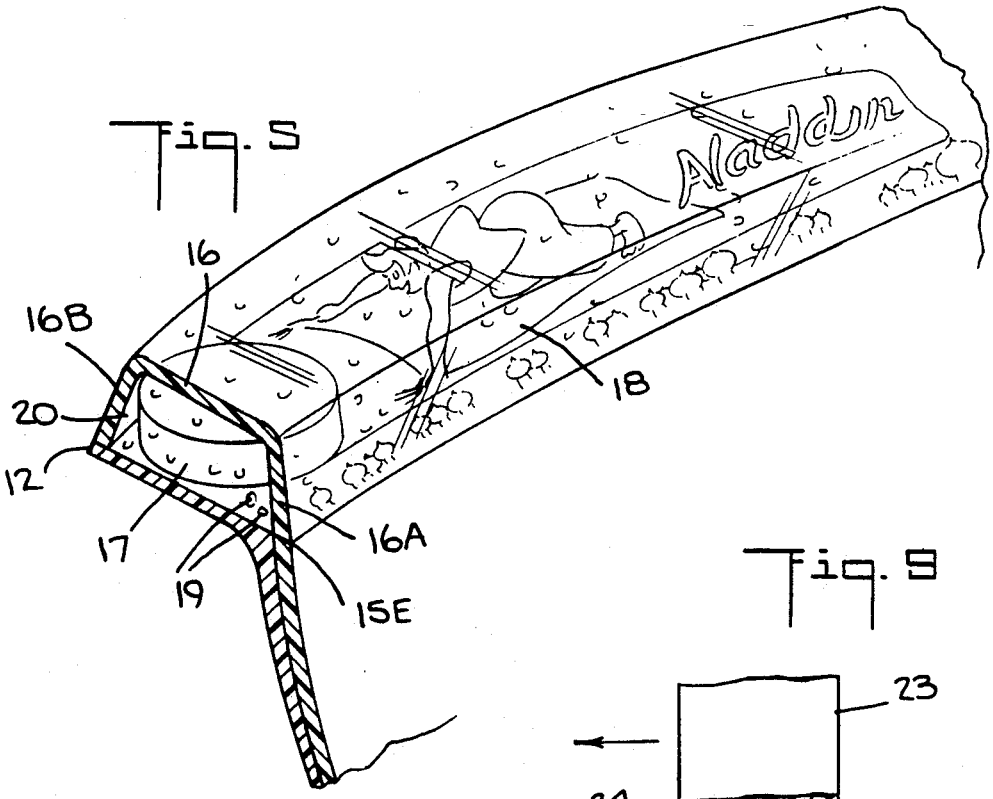
FIG. 5 shows a cut-away portion of the liquid-filled duct forming the rim of the bowl.

Referring now to FIGS. 1 to 5, there is shown novelty dishware in accordance with the invention in the form of a bowl, which is preferably molded of polycarbonate or other high-strength synthetic plastic material. The bowl includes a shell 10 formed of opaque plastic having a concavity resting on a circular base 11, the upper end of the shell terminating in an outwardly-extending circular shelf 12. Formed in shelf 12 is a small port 13 whose underside is sealable by a plastic stopper 14.

In order to render scratch-proof the exposed surface of shell 10, which when the bowl is in use is engaged by an eating implement such as a spoon, this surface is coated with melamine resin or other wear-resistant plastic coating material.

Ultrasonically welded or otherwise bonded to shelf 12 of shell 10 is a channel-shaped ring 16 of transparent plastic material, such as an acrylic plastic. Ring 16 is formed by concentric side walls 16A and 16B bridged by a flat top wall 16C. The spacing between side walls 16A and 16B is such that the inner wall 16A rests on the inner periphery of shelf 12 and outer wall 16B on the outer periphery of the sheet. When ring 16 is joined to shelf 12 of the bowl, it then defines the rim thereof and creates in combination with shelf 12 an annular sealed duct having a rectangular cross section. Shelf 12 functions as the base wall of the duct and the flat top wall 16C of ring 16 as the upper wall of the duct.

Alternatively, instead of joining the channel-shaped ring 16 directly to shelf 12, a flat ring having the same dimensions as the shelf and formed of the same or similar plastic material may be thermally or otherwise joined to the shelf, and the channel-shaped ring joined to the flat ring, the flat ring then functioning as the base wall of the duct.

In practice, the exposed surface of shelf 12, which is visible through transparent ring 11, may be silk screen printed with artwork thematically related to the decorative scheme given to the bowl. This scheme must, of course, be appropriate to children. Thus, assuming that the decorative scheme involves Aladdin, a youth in the Arabian Nights' Entertainment, who comes into possession of a magic lamp and travels on a flying carpet, then silk-screen printed on the shelf is a silhouette of an Arabian city landscape, including mosques and other typical Arab edifices.

Slidable within the duct is a miniature permanent-magnet piston 17 in round wafer form whose diameter approaches the width of the annular duct, so that when the piston is caused to advance through the duct, the piston then forces liquid filling the duct to circulate. Piston 17 is coated with a colored plastic layer, so that the piston is a visible, decorative element within the transparent duct.

Secured to the underside of piston 17 is one end of a thin plastic strip serving as a tail and having an arcuate form whose curvature conforms to that of the annular duct, so that as the wafer-shaped piston is advanced in the duct, the tail is carried thereby. Strip 18 has imprinted thereon in decorative colors a figure of Aladdin riding on a flying carpet, so that Aladdin, when the strip is caused to slide in a circular path along the duct, appears to be flying over an Arabian city landscape.

The Aladdin theme is given by way of example only; for in practice, any theme suitable for children may be used, such as themes based on Disney characters, such as Mickey Mouse, etc. The transparent top wall 16C of the duct may also have imprinted thereon graphics appropriate to the selected theme, but these graphics must have open spaces to permit one to see into the duct.

Also contained in the sealed duct are light-weight glitter particles 19. These may be formed by shredding vacuum-metallized plastic films of acetate or Mylar. The metallization is such as to produce iridescent colors having a high glitter. Filling the duct is a clear liquid 20, which is non-toxic and preferably has anti-freeze properties, so that it will not freeze when the bowl is exposed to low temperatures.

In making the bowl, the glitter particles and the piston provided with a tail are introduced into the duct before ring 16 is bonded to the inner and outer plastic shells. Liquid is then injected into the duct through port 13 in shelf 12 of the outer shell, after which the port is sealed by stopper 14, and the liquid and all other elements within the duct are then entrapped therein.

When the bowl is manipulated to cause the liquid in the sealed duct to circulate, this will animate the particles dispersed in the liquid and carried thereby to create a dynamic display. But, as will later be explained in greater detail, one can also create this display, not by manipulating the bowl, but while the bowl contains food and is resting on a table. This effect is accomplished by means of an eating utensil whose handle has attached to its free end a miniature permanent-magnet actuator which becomes magnetically linked to piston 17 when the free end of the handle is placed by a child on the top wall of the duct at a position adjacent the piston within the duct. Then when the actuator is slid by the child the top surface, this will cause the piston magnetically linked thereto to advance within the annular duct, and in doing so to force the liquid therein to circulate.

The Eating Implements

Figure 6:
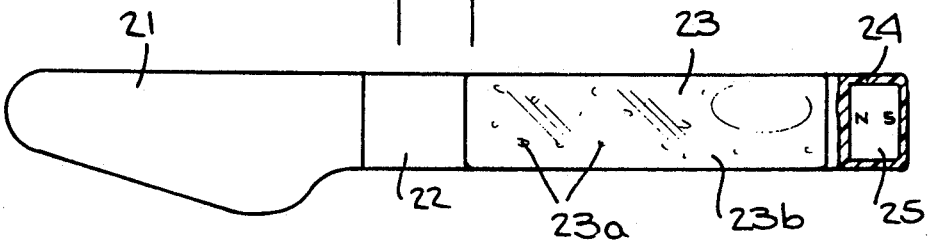
FIG. 6 is an eating implement in accordance with the invention usable in conjunction with the bowl or other dishware, the implement being in the form of a knife.

FIG. 6 shows an eating implement in the form of a knife that is usable with novelty dishware having an annular duct of the type shown in FIGS. 1 to 5, the duct having slidable therein a permanent-magnet piston 17.

The knife includes a metal blade 21 of stainless steel or other suitable material, such as high-strength, synthetic plastic. Blade 21 is provided at its rear end with a tubular socket 22 into which is inserted the leading end of a cylindrical handle 23 of transparent, tubular plastic material, such as acrylic. Closing the rear end of handle 23 and attached thereto is a cylindrical plastic cap 24 within which is enclosed a miniature permanent-magnet actuator 25 in wafer form.

Handle 23 is filled with an anti-freeze liquid of the type used in the duct of the bowl, and dispersed in this liquid are glitter particles similar to those found in the duct. Hence, when a child shakes the handle, a dynamic display will be produced.

The knife shown in FIG. 1, while useful as a conventional eating implement, is also capable of functioning as a pay piece to produce a dynamic display in the annular duct of the bowl or any other form of receptacle whose rim is constituted by an annular duct, as shown in FIGS. 1 to 5.

Figure 9:
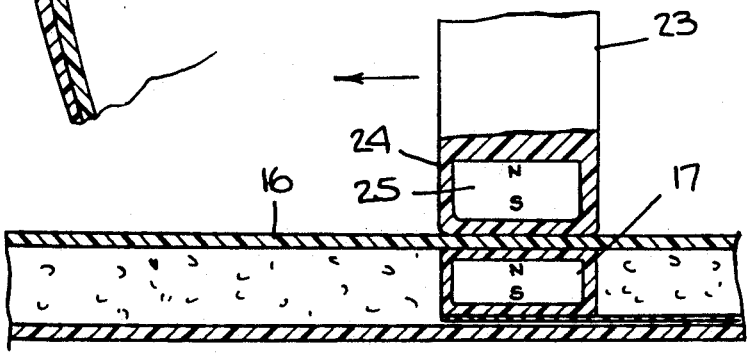
FIG. 9 illustrates the relationship between the permanent magnet actuator attached to the free end of an implement handle and a permanent magnet piston slidable in the duct of the bowl.

Thus, as shown in FIG. 9, when cap 24 on the rear end of the implement handle is placed on top wall 16C of the duct at a position adjacent piston 17 in the duct, the permanent-magnet actuator 25 in the cap is then magnetically linked to the piston. For this to happen, permanent-magnet actuator 25 embedded in the cap must be polarized so that the pole adjacent the pole of the permanent-magnet piston is of opposite polarity. Thus, FIG. 9 shows that it is the south pole of actuator 25 which is adjacent the north pole of piston 17.

As a consequence, when the child holding the implement then slides it along the surface of top wall 16C of the duct in either direction, this will cause a corresponding movement of piston 17 within the duct. When this takes place, the piston will propel the liquid in the duct to circulate and thereby create a dynamic display.

Some degree of skill is involved in producing an effective dynamic display, for the magnetic link between the actuator and the piston is not strong. Hence if the child moves the actuator too fast, the piston, whose movement within the duct is resisted by the liquid, will not be able to keep up with the actuator, and its magnetic linkage with the actuator will be broken. The child must therefore learn to control movement of the actuator so as to maintain an unbroken magnetic link with the piston.

Figure 7:
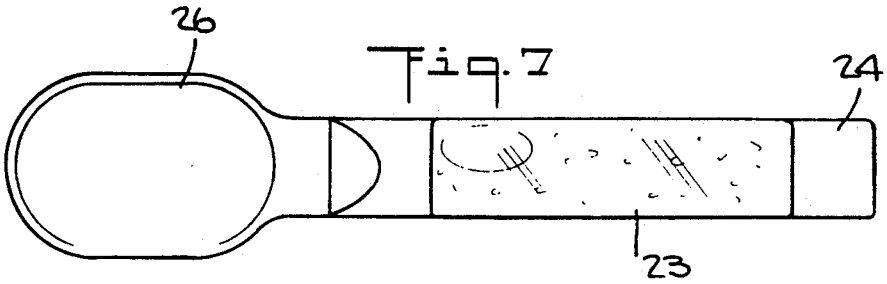
FIG. 7 shows a spoon in accordance with the invention.
Figure 8:
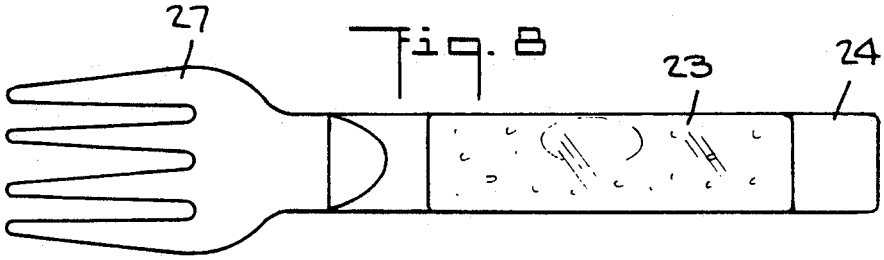
FIG. 8 shows a fork in accordance with the invention.

The implements shown in FIGS. 7 and 8 are identical to that shown in FIG. 6 and have the same handle and cap, except that in FIG. 7, the implement is a spoon having a spoon-shaped element 26 attached to handle 23, while in FIG. 8, the implement is a multi-tined fork element 27 attached to handle 23.

In all cases, the eating implement is provided with a permanent-magnet actuator attached to the free end of the handle, so that a child who uses the implement to eat can also use it as a play piece in conjunction with novelty dishware whose rim is formed by a liquid-filled annular duct.

The Plate

Figure 10:
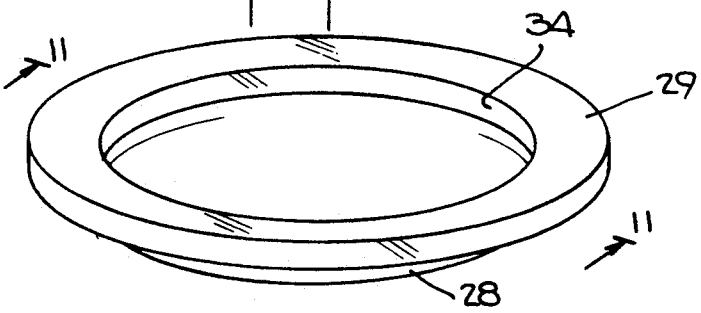
FIG. 10 shows, in perspective, an eating plate in accordance with the invention.
Figure 11:
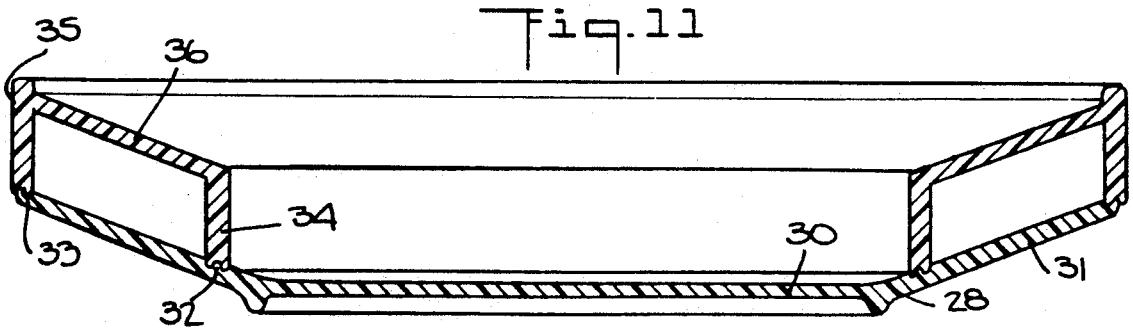
FIG. 11 is a section taken through the plate.

FIGS. 10 and 11 show a novelty plate in accordance with the invention fabricated of synthetic plastic material. The plate is composed of a base element 28 and a top element 29. Base element 28, which may be made of opaque plastic material, is formed by a disc 30 integral with a surrounding annular flange 31 that is slightly inclined upwardly with respect to the disc. A raised, circular inner ridge 32 is formed at the junction of the disc and the flange, and a circular outer ridge 33 is formed on the periphery of the flange.

The top element 29, which is made of transparent plastic material, is in the form of an annular ring having a circular inner wall 34 whose edge is provided with a groove to receive inner ridge 32 of the base element and a concentric outer wall 35 whose edge is provided with a groove to receive outer ridge 33. Inner and outer walls 34 and 35 of the annular ring are bridged by a top wall 36 which is inclined relative to the horizontal plane, so that when annular ring 29 is ultrasonically welded or otherwise joined to bottom element 28, a sealed duct is created which acts as the rim of the plate. This duct is filled with liquid, glitter particles and a permanent-magnet piston as in the bowl duct. Hence a dynamic display can be produced by means of an implement having an actuator magnet attached to the free end of its handle in the manner previously described.

Play Activity

One can with novelty dishware and eating implements in accordance with the invention use these to serve and eat food just as with conventional utensils for this purpose. But since these novel utensils also function as play pieces, a child or his parent can improvise all sorts of games to accompany the eating process.

A game which is highly effective in stimulating a child to eat is one that rewards him for each mouthful of food he partakes. Thus, if the child has before him on the table a bowl of the type shown in FIGS. 1 to 5 containing soup, and the child is provided with a spoon of the type shown in FIG. 7 with which to consume the soup, the rules of the game may be as follows:

After dipping the spoon in the soup and consuming a single mouthful, the child may then use his spoon as an actuator to animate the glitter particles in the annular duct forming the rim of the bowl. But he is not permitted to take a second mouthful of soup unless he has succeeded in animating the glitter particles by causing the magnet piston to make a full circle in the duct to produce a dynamic display. At this point, the child must again dip his spoon in the bowl and repeat the procedure to produce a second full dynamic display, and so on. But only if the child carries out these successive steps a sufficient number of times to empty the bowl of soup, is the child then rewarded by being permitted to play with the empty bowl and the spoon for, say, 5 minutes, after which the child must wash out the bowl and clean the spoon.

The above game plan is by no means the only one that can be devised by a parent to coordinate the eating process with play activity and therefore makes it enjoyable, so as to encourage a child to eat his food.

Psychological factors come into play in eating, for a child's appetite is stimulated by pleasurable activity, whereas it is depressed when the child senses parental pressure to make him eat.

While there have been shown and described preferred embodiments of novelty dishware and eating implements in accordance with the invention, it will be appreciated that many changes and modifications may be made therein without, however, departing from the essential spirit thereof.

I claim:

1. A receptacle adapted to accommodate food to be eaten by a child by means of an eating implement which is appropriate to the nature of the food, said receptacle comprising:

(a) a rounded, rigid vessel with an upper edge for receiving the food;

(b) a rim on the vessel formed by an annular perimeter flange extending outward from said upper edge of said vessel, a sealed duct attached to said flange, said duct having transparent, upstanding, rigid side walls and a top wall of transparent material; and (c) clear liquid filling the duct and having decorative particles dispersed therein, whereby when the liquid is caused to circulate in the duct, the particles are then animated to create a dynamic display, further including a permanent-magnet piston disposed in said duct and slidable therein, said piston being magnetically engageable by said implement whereby when the piston is advanced in either direction, it acts to propel the liquid to cause it to circulate, so that the child can create a dynamic display in the course of eating food.

2. An eating implement in combination with a receptacle as set forth in claim 1, said implement having a handle to whose free end is attached a permanent-magnet actuator, which, when the actuator placed on the top wall of the duct adjacent the piston, it becomes magnetically linked thereto, movement of the actuator along the top wall causing a corresponding movement of the piston.

3. An implement as set forth in claim 2, wherein said handle is formed by a cylindrical tube of transparent material closed at its front end and its rear end and filled with liquid in which decorative particles are dispersed which are animated when the implement is manipulated.

4. An implement as set forth in claim 3, wherein an eating element is attached to the front end of the tube and a non-magnetic cap is attached to the rear end thereof, said cap having said actuator enclosed thereon.

5. A receptacle as set forth in claim 1, in the form of a bowl having a shell provided with an outwardly extending circular shelf, and an annular ring of transparent material having concentric inner and outer side walls and a top wall bridging the walls, said inner side wall being joined to the inner periphery of the shelf, and said outer side wall being joined to the shelf at its outer periphery to define said duct.

6. A receptacle as set forth in claim 5, wherein said bowl is formed of opaque polycarbonate material, and said shelf has a port therein through which said liquid is introduced into the duct.

7. A receptacle as set forth in claim 6, wherein said shelf has artwork printed thereon related to a specific theme, and said piston has a tail strip attached thereto having artwork thereon relating to the same theme.

8. A receptacle as set forth in claim 1 in the form of a plate.

9. A receptacle as set forth in claim 1, in which said vessel is formed by a base element defined by a circular disc surrounded by an upwardly-inclined circular flange, and a channel-shaped top element of transparent material having concentric side walls, one of which is joined to the junction of the disc and the flange, the other being joined to the periphery of the flange to define said duct.

* * * * *